US008058805B2

(12) United States Patent
Lim et al.

(10) Patent No.: US 8,058,805 B2
(45) Date of Patent: Nov. 15, 2011

(54) PLASMA DISPLAY PANEL

(75) Inventors: Sung-Hyun Lim, Suwon-si (KR); Young-Kee Kim, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 0 days.

(21) Appl. No.: 12/715,341

(22) Filed: Mar. 1, 2010

(65) Prior Publication Data

US 2011/0043107 A1 Feb. 24, 2011

Related U.S. Application Data

(60) Provisional application No. 61/235,305, filed on Aug. 19, 2009.

(51) Int. Cl.
*H01J 17/49* (2006.01)

(52) U.S. Cl. ..... 313/587; 313/582

(58) Field of Classification Search ..... 313/582–587
See application file for complete search history.

(56) References Cited

U.S. PATENT DOCUMENTS

| | | | | |
|---|---|---|---|---|
| 7,348,729 | B2 * | 3/2008 | Miyashita et al. | 313/587 |
| 2006/0012721 | A1 * | 1/2006 | Morita et al. | 348/739 |
| 2008/0042572 | A1 * | 2/2008 | Kwon et al. | 313/582 |
| 2008/0290800 | A1 | 11/2008 | Saitoh et al. | |
| 2009/0153050 | A1 * | 6/2009 | Tsuji et al. | 313/582 |

FOREIGN PATENT DOCUMENTS

| | | | |
|---|---|---|---|
| EP | 1 883 092 | A2 | 1/2008 |
| EP | 1 990 826 | A1 | 11/2008 |
| JP | 2002-110048 | | 4/2002 |
| JP | 2002-231129 | | 8/2002 |
| JP | 2008-112745 | | 5/2008 |
| KR | 10-2007-0085084 | A | 8/2007 |
| WO | WO2007/139183 | | 12/2007 |
| WO | WO 2008/155821 | A1 | 12/2008 |
| WO | WO 2009/044456 | A1 | 4/2009 |

OTHER PUBLICATIONS

European Search Report dated Apr. 20, 2011, for corresponding European Patent application 10250708.4, noting listed references in this IDS, as well as U.S. Publication 2006/0012721 previously cited in U.S. Office action dated Dec. 27, 2010.

* cited by examiner

*Primary Examiner* — Anne Hines
(74) *Attorney, Agent, or Firm* — Christie, Parker & Hale, LLP

(57) ABSTRACT

A PDP includes first and second substrates facing each other, a plurality of address electrodes disposed on one surface of the first substrate, a first dielectric layer covering the address electrodes, barrier ribs disposed between the first substrate and the second substrate and partitioning a plurality of discharge cells, a phosphor layer disposed in the discharge cells, a plurality of display electrodes disposed in a direction generally perpendicular to the address electrodes and positioned on the surface of the second substrate facing the first substrate, a second dielectric layer covering the display electrodes, and a protective layer covering the second dielectric layer. The protective layer includes particles of strontium oxide (SrO).

12 Claims, 4 Drawing Sheets

PLASMA DISPLAY PANEL

CROSS-REFERENCE TO RELATED APPLICATION

This application claims priority to and the benefit of Provisional Patent Application No. 61/235,305 filed in the U.S Patent and Trademark Office on Aug. 19, 2009, the entire content of which is incorporated herein by reference.

BACKGROUND OF THE INVENTION

1. Field of the Invention

The present invention relates to a plasma display panel (PDP).

2. Description of the Related Art

A PDP is a display device that displays images by exciting a phosphor layer with vacuum ultraviolet (VUV) rays generated by gas discharge in discharge cells. As PDPs can be fabricated with wide screens and high resolution, they have been spotlighted as next generation flat panel displays.

The PDP has a general three electrode surface-discharge structure. The three electrode surface-discharge structure includes a front substrate including a display electrode having two electrodes, and a rear substrate positioned a distance from the front substrate and having an address electrode. The display electrodes are covered with a dielectric layer. The space between the front and rear substrates is partitioned with barrier ribs into a plurality of discharge cells, into which a discharge gas is injected. A phosphor layer is formed on the rear substrate.

In addition, a protective layer is disposed thereon to protect the dielectric layer from ion impact during the discharge.

SUMMARY OF THE INVENTION

According to one embodiment of the present invention, a plasma display panel (PDP) has improved discharge characteristics and high luminance and efficiency.

According to another embodiment of the present invention, a PDP includes a first substrate and a second substrate facing each other, a plurality of address electrodes on a surface of the first substrate, a first dielectric layer on the first substrate covering the address electrodes, barrier ribs disposed in the space between the first and second substrates and partitioning a plurality of discharge cells, a phosphor layer in the discharge cells, a plurality of display electrodes positioned on a surface of the second substrate that faces the first substrate in a direction generally perpendicular to the direction of the address electrodes, a second dielectric layer on the second substrate covering the display electrodes, and a protective layer covering the second dielectric layer. Particles of strontium oxide (SrO) are disposed on the protective layer.

The SrO particles may include at least 5 wt % strontium oxide. The particles may further include another oxide selected from magnesium oxide (MgO), calcium oxide (CaO), barium oxide (BaO), zinc oxide (ZnO), and aluminum oxide ($Al_2O_3$).

The particles may also further include at least one oxide selected from silicon oxide ($SiO_2$), aluminum oxide ($Al_2O_3$), titanium oxide ($TiO_2$), magnesium oxide (MgO), calcium oxide (CaO), zinc oxide (ZnO), and boron oxide ($B_2O_4$), or fluorine.

The particles may have an average particle size ranging from about 50 nm to about 10 μm.

The protective layer may further include a coating layer on the particles. The coating layer may include an oxide. The oxide may include at least one oxide selected from silicon oxide ($SiO_2$), aluminum oxide ($Al_2O_3$), titanium oxide $TiO_2$, magnesium oxide (MgO), calcium oxide (CaO), zinc oxide (ZnO), and boron oxide ($B_2O_4$).

The coating layer may include fluorine. The coating layer may have a thickness ranging from about 5 nm to about 300 nm.

The protective layer may further include a thin film positioned under the plurality of particles, and the thin film may include magnesium oxide (MgO).

The PDP may further include discharge gas filled in the discharge cells, and the discharge gas may include xenon (Xe). The xenon may be included therein at a partial pressure ratio of at least 10%.

DETAILED DESCRIPTION OF THE INVENTION

Figure 1:
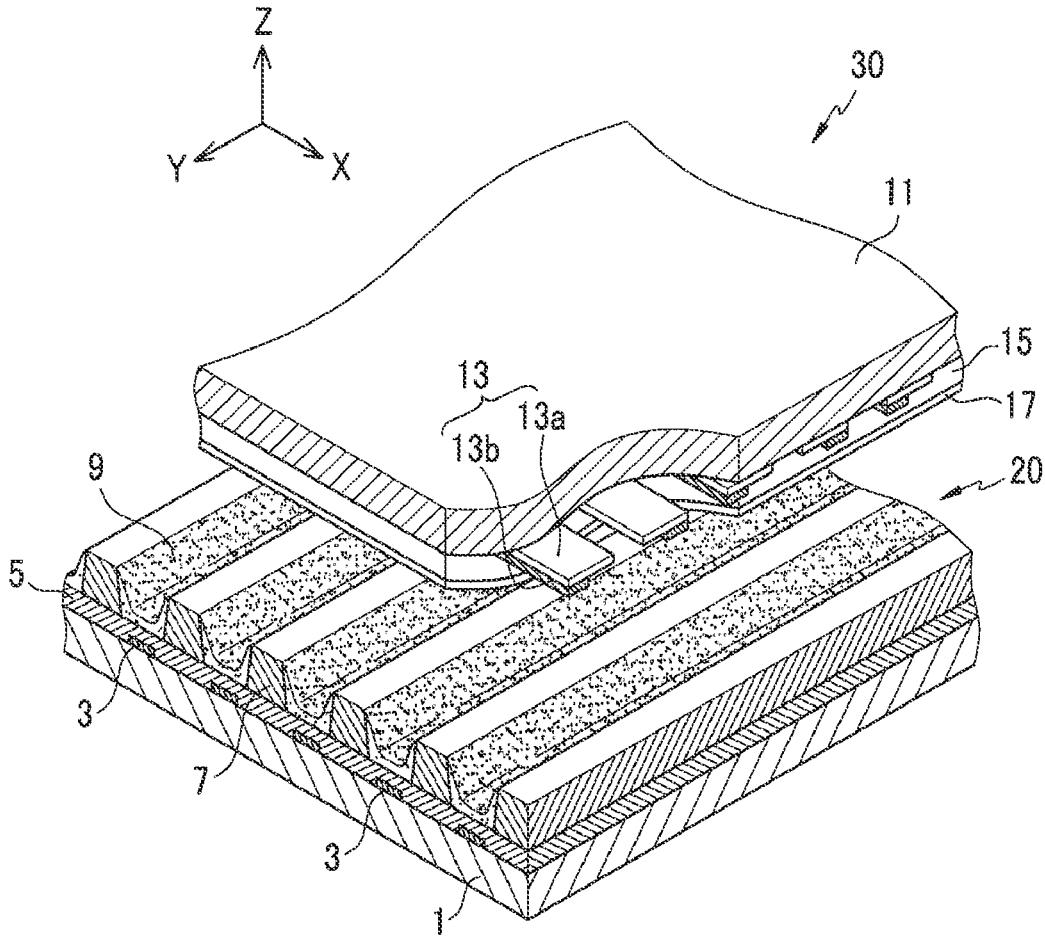
FIG. 1 is an exploded perspective view of a PDP according to one embodiment of the present invention.

Exemplary embodiments of the present invention will now be described with reference to the accompanying drawings. However, these embodiments are only exemplary, and the present invention is not limited thereto.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, the element may be directly on the other element or may be on an intervening element. In contrast, when an element is referred to as being "directly on" another element, there is no intervening element present.

Figure 2:
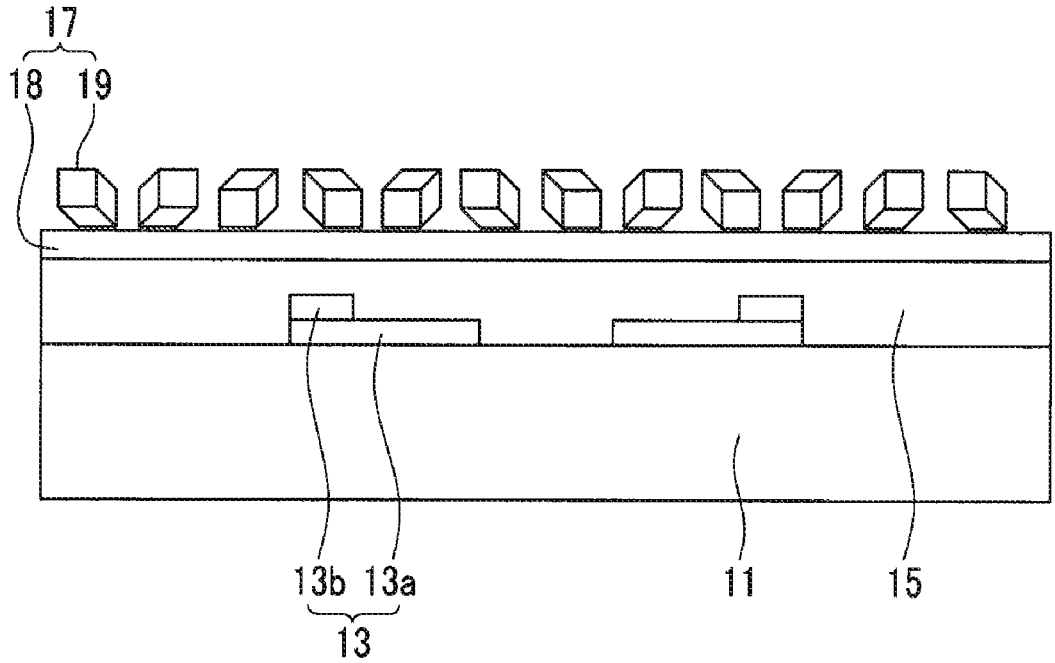
FIG. 2 is an enlarged partial cross-sectional view of the second display panel of the PDP shown in FIG. 1.

FIGS. 1 and 2 depict a plasma display panel (PDP) according to one embodiment of the present invention. FIG. 1 is an exploded perspective view of a PDP according to one embodiment of the present invention, and FIG. 2 is an enlarged partial cross-sectional view of the second display panel of the PDP shown in FIG. 1. Referring to FIG. 1, a plasma display panel (PDP) of the present invention includes a first display panel (or first substrate) 20 and a second display panel (or second substrate) 30 disposed parallel to each other and separated from each other by a distance.

On the first substrate 1, a plurality of address electrodes 3 are disposed along a first direction (the Y direction in the drawing), and a first dielectric layer 5 covers the address electrodes 3. The first dielectric layer 5 accumulates wall charges while preventing positive ions or electrons from directly colliding against the address electrodes 3 during discharge and damaging the address electrodes 3.

On the first dielectric layer 5, a plurality of barrier ribs 7 are disposed between the address electrodes 3. The illustrated barrier ribs 7 have heights and striped shapes to partition discharge spaces. However, the barrier ribs 7 may take any shape or size, and may have a closed shape (such as a waffle, a matrix, or a delta shape) as well as an open shape (such as a stripe), as long as they partition the discharge spaces.

Then, a plurality of discharge cells are formed among each barrier rib 7, in which primary color phosphor layers 9 (such as red, green, and blue) are formed. The phosphor layers 9 absorb vacuum ultraviolet (VUV) radiation and emit visible light. The discharge cells are filled with a discharge gas, such as helium (He), neon (Ne), argon (Ar), xenon (Xe), and mixtures thereof, so that the gases are discharged and emit vacuum ultraviolet (VUV) radiation.

Hereinafter, the second display panel (or second substrate) 30, which faces the first display panel (or first substrate) 20 will be described. First, a plurality of display electrodes 13 are disposed in a second direction generally perpendicular to the first direction of the address electrodes 3 (X-axis direction in the drawing) on the side of the second substrate 11 facing the first substrate 1. Each display electrode 13 includes a transparent electrode 13*a* and a bus electrode 13*b*. The transparent electrode 13*a* and the bus electrode 13*b* overlap.

The transparent electrode 13*a* causes a surface discharge inside the discharge cell and can be prepared to secure the aperture ratio of the discharge cell by using a transparent conductor such as ITO or IZO. Since the bus electrode 13*b* provides the transparent electrode 13*a* with voltage signals and is formed of a metal with low resistance, it may prevent resistance decreases.

A second dielectric layer 15 covers the display electrodes 13. The second dielectric layer 15 protects the display electrodes 13 from being damaged by gas discharge and accumulates wall charge during the discharge.

A protective layer 17 is disposed on the second dielectric layer 15. Referring to FIG. 2, the protective layer 17 includes a protective thin film 18 and a plurality of particles 19 on the protective thin film 18 covering the surface (and in some embodiments, the entire surface) of the second dielectric layer 15.

The protective thin film 18 may include magnesium oxide (MgO) and prevents the second dielectric layer 15 from being damaged during discharge and prevents impurities from attaching to the second dielectric layer 15.

The particles 19 include strontium oxide (SrO) as a main component. The particles 19 may further include other oxides in addition to the strontium oxide. For example, the oxide may include at least one oxide selected from magnesium oxide (MgO), calcium oxide (CaO), barium oxide (BaO), zinc oxide (ZnO), and aluminum oxide ($Al_2O_3$). The strontium oxide may be included in an amount of about 5 to about 100 wt % based on the entire amount of the component.

The particles 19 may have a cubic shape with an average particle size ranging from about 50 nm to about 10 μm, but the particles are not limited thereto and may take various shapes, for example cylindrical shapes, prismatic shapes, or prismatic cones.

The particles 19 may be prepared by various methods, for example, monocrystalline growth through electric fusion, and multicrystalline formation through sintering, vapor deposition, and the like. For example, the particles 19 including strontium oxide may be prepared by firing a strontium oxide precursor at a high temperature of 500° C. or greater and then cooling it down. Nonlimiting examples of the strontium oxide precursor include strontium alkoxide, strontium acetate, strontium isopropoxide, and hydrates thereof. In addition, the size of the particles may be controlled by milling the particles (such as strontium oxide and the like).

Figure 4:
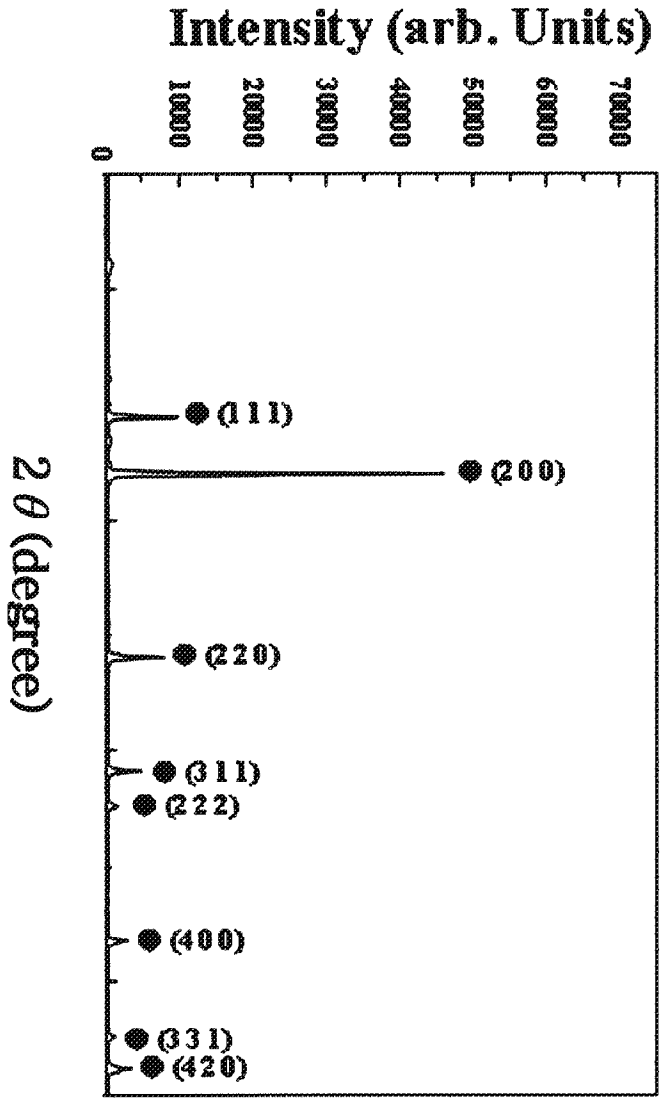
FIG. 4 is an graph of X-ray diffraction (XRD) results showing the crystal growth direction of the particles.

FIG. 4 is a graph of X-ray diffraction (XRD) results illustrating a crystal growth direction of a particle. FIG. 4 shows the crystal growth directions (111) and (200) of a particle including strontium oxide as a main component and calcium oxide in a small amount.

Strontium oxide has excellent secondary electron discharge characteristics against discharge gases such as helium (He), neon (Ne), argon (Ar), and xenon (Xe), and thus may decrease the sustain voltage. In particular, since it has better secondary electron discharge characteristics against xenon (Xe), xenon gas with a high partial pressure ratio may be more appropriately used as a discharge gas. Accordingly, when xenon (Xe) with a partial pressure ratio ranging from about 10 to about 100% is used as a discharge gas, it may increase discharge efficiency. In one embodiment, for example, the Xe gas may have a partial pressure ratio of about 10 to about 50%. In another embodiment, the Xe gas has a partial pressure ratio of about 30%. In addition, a protective layer including the strontium oxide may decrease the sustain voltage.

In addition, when the strontium oxide is prepared as particles, it may increase specific surface area, thereby improving efficiency.

In the PDP, discharge cells are formed at positions where the address electrodes 3 and the display electrodes 13 intersect. Address discharge is performed by applying an address voltage (Va) to a space between the address electrodes 3 and the display electrodes 13, and a sustain voltage (Vs) is applied to a space between a pair of the display electrodes 13 to drive a PDP through sustain discharge. The sustain discharge generates an excitation source and excites the corresponding phosphor layer so that the phosphor layer may emit visible light through the transparent second substrate 11 to display an image. The excitation source representatively includes vacuum ultraviolet (VUV) radiation.

The discharge gas filled in the discharge cell may be helium (He), neon (Ne), argon (Ar), xenon (Xe), or a mixture thereof. By including a protective layer including strontium oxide, driving voltage may be sufficiently reduced when xenon (Xe) with the proper partial pressure ratio is included as the discharge gas.

Figure 5:
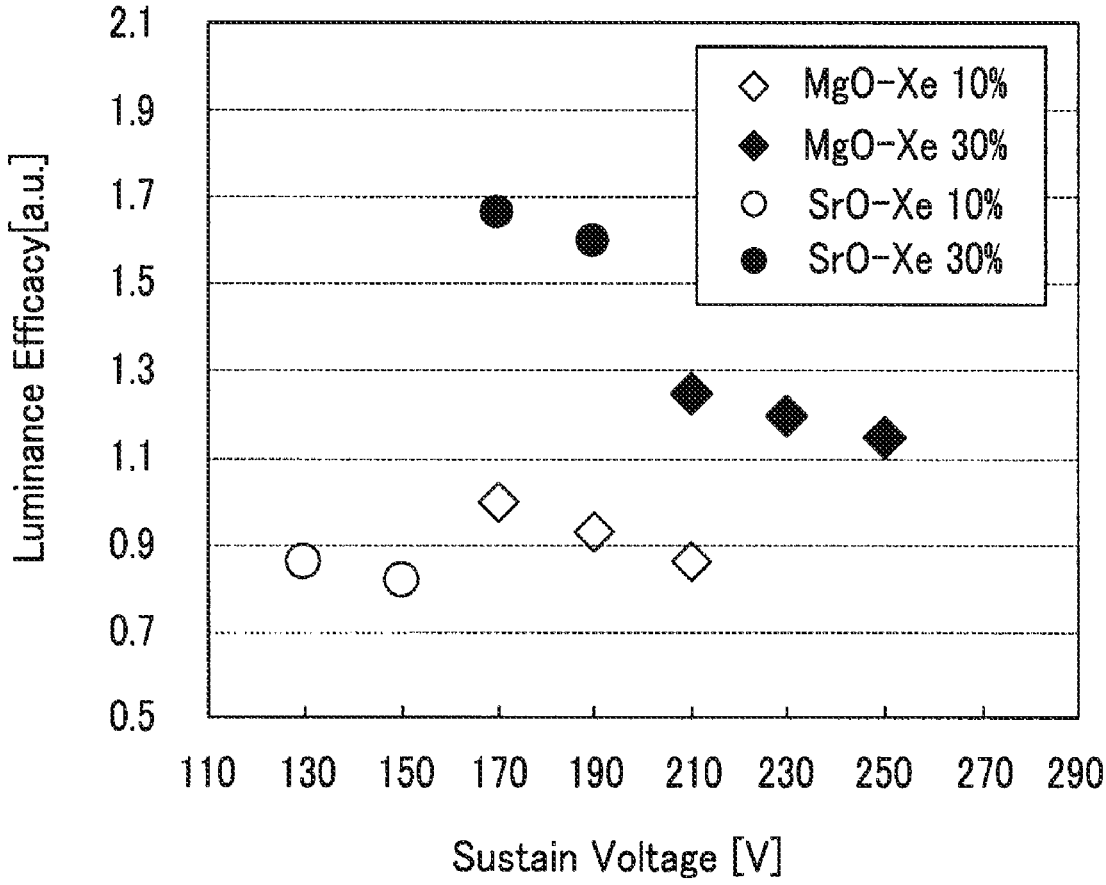
FIG. 5 is a graph of efficiency versus voltage of a PDP according to one embodiment of present invention.

FIG. 5 is a graph of efficacy versus voltage of a PDP according to one embodiment of present invention. Referring to FIG. 5, when xenon (Xe) is included as a discharge gas, a protective layer prepared using particles including strontium oxide as a main component had higher luminance efficacy at the same sustain voltage than the protective layer including magnesium oxide as the main component. Accordingly, a lower sustain voltage is needed to accomplish the same luminance efficacy.

In particular, the particles including strontium oxide as a main component may have less sustain voltage than the one including magnesium oxide as a main component by about 40V. In addition, strontium oxide-xenon 30% (SrO—Xe 30%) increases efficiency by about 65% compared with magnesium oxide-xenon 10% (MgO—Xe 10%) based on about 170V.

According to one embodiment of the present invention, a protective layer prepared using particles including strontium oxide may maintain low sustain voltages and high luminance efficacy against a discharge gas such as xenon (Xe).

Figure 3:
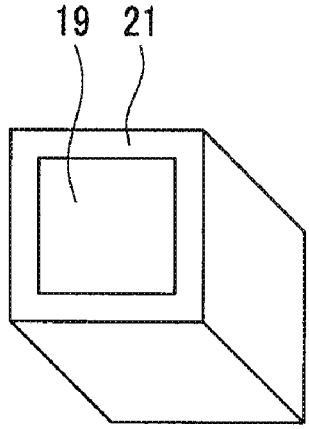
FIG. 3 is a schematic perspective view of particles according to another embodiment of the present invention.

FIG. 3 is a schematic perspective view of a particle according to another embodiment of the present invention. Referring to FIG. 3, a particle 19 is coated with a coating layer 21. The coating layer 21 is made of at least one oxide selected from silicon oxide ($SiO_2$), aluminum oxide ($Al_2O_3$), titanium oxide ($TiO_2$), magnesium oxide (MgO), calcium oxide (CaO), zinc oxide (ZnO), and boron oxide ($B_2O_4$). The coating layer 21 may be surface-treated with heat or plasma. The coating layer 21 may also be surface-treated with fluorine-containing gas.

The oxide or fluorine formed through surface treatment flows into the particle 19, and thus the particle 19 may include at least one oxide selected from silicon oxide ($SiO_2$), aluminum oxide ($Al_2O_3$), titanium oxide ($TiO_2$), magnesium oxide (MgO), calcium oxide (CaO), zinc oxide (ZnO), boron oxide ($B_2O_4$), or fluorine.

The coating layer 21 may have a thickness ranging from about 5 to about 300 nm. The coating layer 21 surrounds the particle 19 and prevents the particle 19 from being exposed to oxygen, carbon, and moisture in the atmosphere. Accordingly, it may prevent the strontium oxide in the particle 19 from reacting with oxygen or carbon or absorbing moisture in the atmosphere (which would cause a deterioration in transmittance), thereby preventing overall luminance decreases in the plasma display panel (PDP).

While the present invention has been described in connection with certain exemplary embodiments, it is understood by those of ordinary skill in the art that certain modifications may be made to the described embodiments without departing from the spirit and scope of the present invention, as defined by the appended claims.

What is claimed is:

1. A plasma display panel, comprising:

a first substrate comprising a plurality of address electrodes;

a first dielectric layer on the address electrodes;

a plurality of barrier ribs on the first dielectric layer, wherein the barrier ribs define a plurality of discharge spaces;

a second substrate facing the first substrate and comprising a plurality of display electrodes;

a second dielectric layer on the display electrodes;

a protective layer on the second dielectric layer; and at least one particle on the protective layer, wherein the at least one particle comprises SrO and at least one material selected from the group consisting of silicon oxide ($SiO_2$), aluminum oxide ($Al_2O_3$), titanium oxide ($TiO_2$), magnesium oxide (MgO), calcium oxide (CaO), zinc oxide (ZnO), boron oxide ($B_2O_4$), and fluorine, wherein the SrO is a main component of the at least one particle.

2. The plasma display panel according to claim 1, wherein the at least one particle has an average particle size of from about 50 nm to about 10 μm.

3. The plasma display panel according to claim 1, further comprising a coating on at least a portion of the at least one particle.

4. The plasma display panel according to claim 3, wherein the coating comprises an oxide.

5. The plasma display panel according to claim 4, wherein the oxide comprises a material selected from the group consisting of silicon oxide ($SiO_2$), aluminum oxide ($Al_2O_3$), titanium oxide ($TiO_2$), magnesium oxide (MgO), calcium oxide (CaO), zinc oxide (ZnO), boron oxide ($B_2O_4$), and combinations thereof.

6. The plasma display panel according to claim 3, wherein the coating comprises fluorine.

7. The plasma display panel according to claim 3, wherein the coating has a thickness of from about 5 nm to about 300 nm.

8. The plasma display panel according to claim 1, wherein the protective layer comprises MgO.

9. The plasma display panel according to claim 1, wherein the discharge spaces comprise at least one discharge gas selected from the group consisting of helium (He), neon (Ne), argon (Ar), and xenon (Xe).

10. The plasma display panel according to claim 9, wherein the discharge gas comprises Xe having a partial pressure ratio of at least about 10%.

11. The plasma display panel according to claim 10, wherein the Xe has a partial pressure ratio of about 30%.

12. The plasma display panel according to claim 9, wherein the discharge gas comprises Xe having a partial pressure ratio from about 10% to about 50%.

* * * * *